US008713730B2

(12) United States Patent
Koh et al.

(10) Patent No.: US 8,713,730 B2
(45) Date of Patent: May 6, 2014

(54) MEDICAL TRANSPORT DEVICE

(75) Inventors: Lawrence R Koh, North Hollywood, CA (US); James D. Huggins, Marietta, GA (US); Charles Blair, Lawrenceville, GA (US)

(73) Assignee: Lawrence R. Koh and Nina Merrell-Koh, Tarzana, CA (US), Trustees, or Their Successors, Under the Lawrence R. Koh and Nina Merrell-Koh Family Trust dated Dec. 5, 1995

( * ) Notice: Subject to any disclaimer, the term of this patent is extended or adjusted under 35 U.S.C. 154(b) by 175 days.

(21) Appl. No.: 13/118,966

(22) Filed: May 31, 2011

(65) Prior Publication Data

US 2012/0304386 A1 Dec. 6, 2012

(51) Int. Cl.
*A47B 1/00* (2006.01)

(52) U.S. Cl.
USPC ..... 5/626; 5/81.1 C; 5/81.1 HS; 5/81.1 R; 5/625

(58) Field of Classification Search
USPC ..... 5/81.1 C, 81.1 HS, 81.1 R, 625, 626
See application file for complete search history.

(56) References Cited

U.S. PATENT DOCUMENTS

| | | | | |
|---|---|---|---|---|
| 3,418,670 | A | 12/1968 | Morgan | |
| 3,654,644 | A | 4/1972 | Stevens | |
| 3,724,005 | A | 4/1973 | Stevens | |
| 4,566,445 | A * | 1/1986 | Jelsma et al. | 606/242 |
| 4,967,427 | A | 11/1990 | Cherepy, Sr. | |
| 5,044,031 | A * | 9/1991 | Sherwood et al. | 2/69.5 |
| 5,219,369 | A * | 6/1993 | Gastle et al. | 5/600 |
| 6,408,466 | B1 | 6/2002 | Blotta | |
| 7,047,578 | B2 * | 5/2006 | Spanton | 5/81.1 R |
| 7,063,202 | B2 | 6/2006 | Ossendorf | |
| 7,228,579 | B2 * | 6/2007 | Tidwell | 5/624 |
| 7,490,377 | B2 * | 2/2009 | Ahlman | 5/81.1 R |
| 2007/0056096 | A1 * | 3/2007 | Assink | 5/81.1 HS |

FOREIGN PATENT DOCUMENTS

| | | |
|---|---|---|
| GB | 1311860 | 3/1973 |
| RU | 2009101001 | 7/2010 |
| WO | 01/47340 | 7/2001 |

* cited by examiner

*Primary Examiner* — William Kelleher
*Assistant Examiner* — Duoni Pan
(74) *Attorney, Agent, or Firm* — Loza & Loza, LLP; Heidi L. Eisenhut

(57) ABSTRACT

Embodiments of the invention are directed to medical transport devices, more particularly, to spineboards. In one embodiment, a spineboard includes an upper panel assembly joined to a lower panel assembly by one or more latch assemblies and one or more hinge assemblies. An upper moveable belt wrap about the upper panel assembly and is driven by a motorized drive roller while a lower moveable belt is wrapped about the lower panel assembly and driven by a separate motorized drive roller. The upper and lower moveable belts counter-rotate relative to one another. The upper moveable belt is used to load and unload an injured person from the spineboard while the lower moveable belt is used to advance the spineboard toward and away from the injured person.

20 Claims, 11 Drawing Sheets

MEDICAL TRANSPORT DEVICE

FIELD

Various features relate to improvements to medical transport devices, and more particularly, to spineboards.

BACKGROUND

A spinal board, also known as a long spine board, a longboard, a spineboard or backboard, is a patient handling device used primarily during pre-hospital trauma care and is designed to provide rigid support during movement of a patient with suspected spinal or limb injuries. Spinal boards may be used in conjunction with one or more stabilizing accessories such as cervical collars with occipital padding, side head supports (e.g., rolled blankets or head blocks used to avoid the lateral rotation of the head), straps to secure the patient to the long spine board, and/or tape to secure the head of the patient.

Conventional spineboards are typically made of plastic or canvas and are typically designed to be slightly wider and longer than the average human body to accommodate the immobilization straps. Conventional spineboards also include handles which provide for the force required for lifting to be distributed and making it easier to carry the patient. Many spineboards are designed to be completely X-ray translucent so that they do not interfere with the exam while patients are strapped to them. Spineboards are commonly used by ambulance services, by staff such as emergency medical technicians and paramedics, but may also be used by specialist emergency personnel such as lifeguards.

Conventional spineboards have many limitations, including but not limited to, requiring significant movement of the injured person onto the spineboard by emergency personnel for transportation. Any movement of a person injured with a spinal injury may result in further injury and damage, such as paralysis. Consequently, there is a need for a spineboard which reduces the movement of the injured person by medical personnel.

SUMMARY

The following presents a simplified summary of one or more implementations in order to provide a basic understanding of some implementations. This summary is not an extensive overview of all contemplated implementations, and is intended to neither identify key or critical elements of all implementations nor delineate the scope of any or all implementations. Its sole purpose is to present some concepts of one or more implementations in a simplified form as a prelude to the more detailed description that is presented later.

According to one feature, a medical transport device, more particularly, a spineboard is provided. The spineboard may include an upper panel assembly comprising: an upper panel; and an upper drive assembly secured to a proximal end of the upper panel; a lower panel assembly detachably joined to the upper panel assembly by one or more latch assemblies and one or more hinge assemblies, the lower panel assembly comprising: a lower panel having a length less than a length of the upper panel assembly; and a lower drive assembly secured to a proximal end of the lower panel; an upper moveable belt wrapped about the upper panel assembly, the upper moveable belt driven by the upper drive assembly; and a lower moveable belt wrapped about the lower panel assembly, the lower moveable belt driven by the lower drive assembly, the upper moveable belt and the lower moveable belt counter-rotate relative to one another.

In one aspect, the upper panel may comprise a core sandwiched between an upper sheet and a lower sheet. The upper panel may define a rectangular configuration where the length and width of the upper and lower sheets exceed the length and the width of the core. A peripheral frame may surround and frame the upper panel.

In yet another aspect, the core may be constructed of a honeycombed material selected from the group consisting of aluminum, stainless steel, Aramid™, polycarbonate and polypropylene.

In yet another aspect, an upper drive assembly may be secured to outer edges of a proximal end of the upper panel. The lower panel assembly, secured to outer edges of a proximal end of the lower panel, may include a lower drive assembly. A first motor may be positioned within the upper drive assembly and a second motor may be positioned within the lower drive assembly.

In yet another aspect, the upper panel assembly may further comprise a nose assembly coupled to a distal end thereto. The nose assembly may include a center section and opposing side sections. The center section, making up approximately ⅓ of the nose assembly, may have no taper while opposing side sections may each have a taper of 1/16 in. to 12 in. Tapering of the nose assembly allows the upper moveable belt to remain centered on the upper panel.

BRIEF DESCRIPTION OF DRAWINGS

The features, nature, and advantages of the present aspects may become more apparent from the detailed description set forth below when taken in conjunction with the drawings in which like reference characters identify correspondingly throughout.

DETAILED DESCRIPTION

The following detailed description is of the best currently contemplated modes of carrying out the present invention.

The description is not to be taken in a limiting sense, but is made merely for the purpose of illustrating the general principles of the present invention.

Embodiments of the invention are directed to medical transport devices, more particularly, to spineboards. In one embodiment, a spineboard includes an upper panel assembly joined to a lower panel assembly by one or more latch assemblies and one or more hinge assemblies. An upper moveable belt may wrap about the upper panel assembly and may be driven by a motorized drive roller while a lower moveable belt may wrap about the lower panel assembly and may be driven by a separate motorized drive roller. In some embodiments, the upper moveable belt and the lower moveable belt counter-rotate relative to one another. The upper moveable belt may be used to load and unload an injured person from the spineboard while the lower moveable belt may be used to advance the spineboard toward and away from the injured person. In one embodiment, the upper panel assembly may include one or more supporting members framing the upper panel assembly and/or at least one cross brace bisecting the upper panel assembly.

Figure 1:
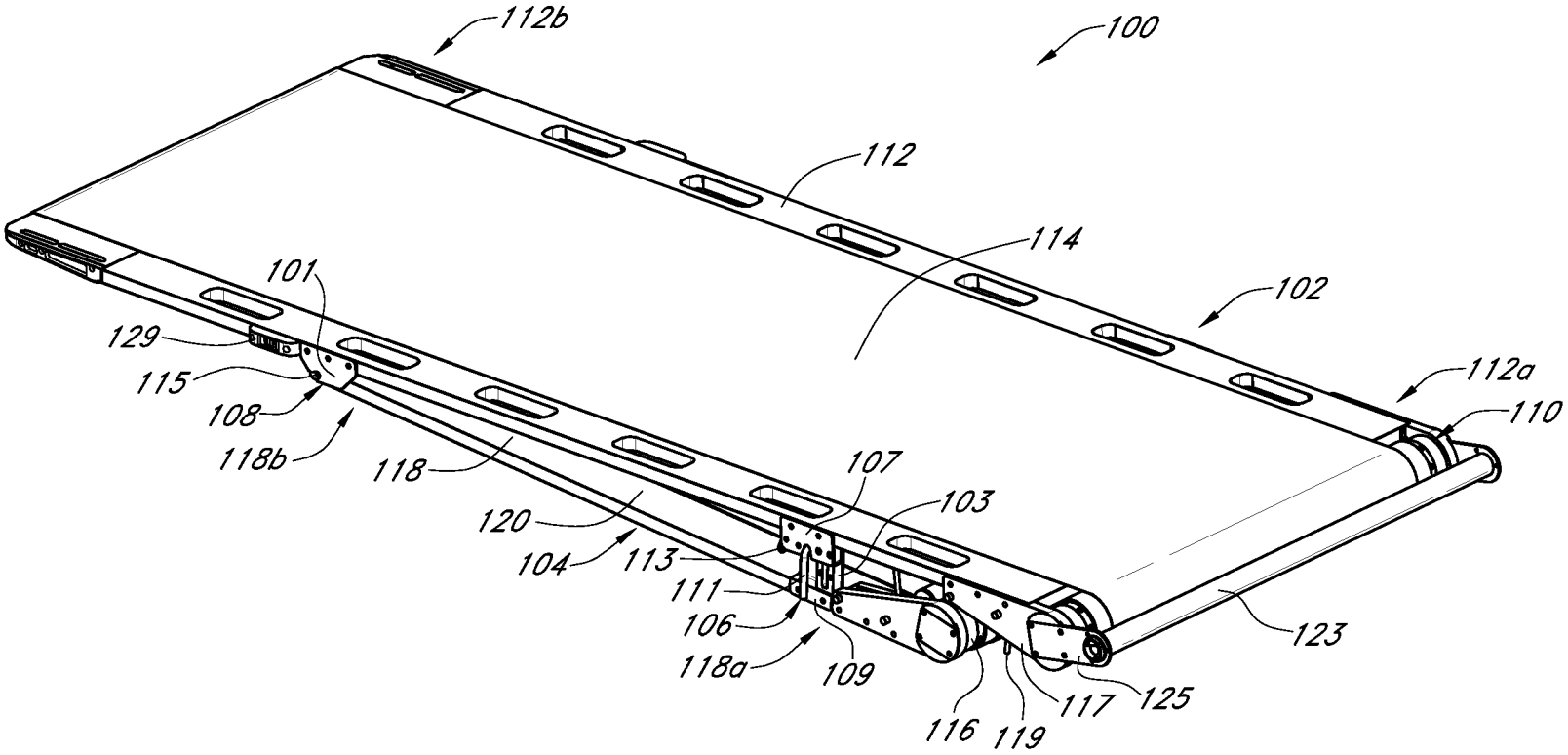
FIG. 1 illustrates a perspective view of a spineboard according to an embodiment of the invention.

FIG. 1 illustrates a perspective view of a spineboard according to an embodiment of the invention. In one embodiment, a spineboard 100 may include an upper panel assembly 102 detachably joined to a lower panel assembly 104 by opposing latch assemblies 106 located on a proximal end of the spineboard 100 and opposing hinge assemblies 108 located on a distal end of the spineboard 100. Latch assemblies 106 may include two-stage rotary type latches, secured to the upper panel assembly 102 via upper latch support members 107, for releasable engagement with latch bars 111, secured to the lower panel assembly 104 via lower latch support members 109. Latch bars 111 may have a generally U-shaped configuration and extend upwardly from the lower latch support members 109. Each of the two-stage rotary type latches may include a lever 113, operable between an actuated and unactuated position, for releasing the latch from the latch bar 111 and a spring (not shown) for returning the lever 113 from an actuated position to an unactuated position, as well as assist with releasement of the latch. Opposing hinge assemblies 108 may include upper hinge support members 101, secured to upper panel assembly 102, and a pin 115 secured to the lower panel assembly 104. The upper hinge support members 101 may include a slot for releasably receiving the pin 115 allowing for the upper panel assembly 102 and the lower panel assembly 104 to be quickly and easily aligned and latched together.

Latch assemblies 106 may further include a delrin block 103 releasably secured to upper panel assembly 102 and lower panel assembly 104. Delrin block 103 may be used to isolate electrical contacts from contacting metal on the spineboard or elsewhere. In accordance with one embodiment, electrical contacts may be used to electrically connect batteries located in the upper panel assembly 102 to a motorized drive roller located in the lower panel assembly 104, as described in further detail below.

To detach the lower panel assembly 104 from the upper panel assembly 102, the lever 113 may be pulled until the latch is released and rotated to an unactuated position. Once in the unactuated position, the upper panel assembly 102 may be lifted upwardly from the lower panel assembly 104 allowing the two-stage rotary type latches to separate and clear away from the lower panel assembly 104. In one embodiment, the upper panel assembly 102 may be lifted approximately 0.72" off the lower panel assembly 104 to separate and clear away the latch assemblies 106 from the lower panel assembly 104. The upper panel assembly 102 may then be moved laterally, approximately 0.5", to disengage from the pin 115.

In one embodiment, upper panel support members 117 may be secured to outer edges of a proximal end 112*a* (as opposed to distal end 112*b*) of an upper panel 112 of the upper panel assembly 102 (partially shown). An upper drive assembly 110 may extend between and be releasably and rotably secured to upper panel support members 117. The upper drive assembly 110 may include a motorized drive roller 110*a* and an upper idler roller 110*b* oriented parallel with and spaced apart from the motorized drive roller 110*a*. (See FIG. 2B) The motorized drive roller 110*a* and upper idler roller 110*b* may be comprised of tubular round, lightweight materials and have a shaft and bearings for allowing the motorized drive roller 110*a* and upper idler roller 110*b* to rotate freely about the shaft. An endless upper moveable belt 114 may wrap about the upper panel 112 and motorized drive roller 110*a* and upper idler roller 110*b*. The motorized drive roller 110*a* (or motor) may be powered by batteries located in the upper panel assembly 102 and rotational movement of the motorized drive roller 110*a* may cause translational movement of the endless upper moveable belt 114 and consequential rotational movement of upper idler roller 110*b* therewith. By releasably securing the upper drive assembly 110 to the inner sides of upper panel support members 117, the upper drive assembly 110 may be easily and quickly removed allowing the upper moveable belt 114 to be quickly removed and replaced. The idler roller 110*b* may be secured to the inner sides of upper panel support members 117 by adjustable screw rods 119 allowing the upper drive assembly 110 to adjust not only the tension but also the alignment of the upper moveable belt 114. The upper drive assembly 110 may provide additional wrap around the drive roller and a means to tension the belt by lengthening the path of the upper moveable belt 114.

Similarly, lower panel support members 131 (See FIG. 7A) may be secured to outer edges of a proximal end 118*a* (as opposed to distal end 118*b*) of a lower panel 118 of the lower panel assembly 104 (partially shown). A lower drive assembly 116 may extend between and be releasably and rotably secured to the lower panel support members 131. The lower drive assembly 116 may include a motorized drive roller 116*a* and a lower idler roller 116*b* oriented parallel with and spaced apart from the motorized drive roller 116*a*. (See FIG. 7B) The motorized drive roller 116*a* and lower idler roller 116*b* may be comprised of tubular round, lightweight materials and have a shaft and bearings for allowing the motorized drive roller 116*a* and lower idler roller 116*b* to rotate freely about the shaft. An endless lower moveable belt 120 may wrap about the lower panel 118 and motorized drive assembly 116*a* and the lower idler roller 116*b*. The motorized drive roller 116*a* (or motor) may be electrically coupled to the batteries in the upper panel assembly 102 via electrical contacts located in the delrin block 103, as described above. Rotational movement of the motorized drive roller 116*a* may cause translational movement of the endless lower moveable belt 120 and consequential rotational movement of lower idler roller 116*b* therewith. By releasably securing the lower drive assembly 116 to the inner sides of lower panel support members 131, the lower drive assembly 116 may be easily and quickly removed allowing the lower moveable belt 120 to be quickly removed and replaced. The lower idler roller 116*b* may be secured to the inner sides of lower panel support members 131 by adjustable screw rods 133 allowing the lower drive assembly 116 to adjust not only the tension but also the alignment of the lower moveable belt 120. The lower drive assembly 116 may provide additional wrap around the drive roller and a means to tension the belt by lengthening the path of the lower moveable belt 120.

The motorized drive rollers 110*a*, 116*a* may be, for example, DC gear motors. The motorized drive rollers 110*a*, 116*a* may operate at a single speed or may include a variable speed control. As described above, both motorized drive rollers 110*a*, 116*a* may be powered by batteries located on the upper panel assembly 102.

In some embodiments, the upper moveable belt 114 and the lower moveable belt 120 may counter-rotate relative to one another. The upper moveable belt 114 and the lower moveable belt 120 may be held in place by friction allowing the belts 114, 120 to be easily removed from the upper drive assembly 110 and the lower drive assembly 116. Proper alignment and tracking of the belts 114, 120 may be accomplished by proper idler roller adjustment and using a tapered roller nose assembly 124. The nose assembly 124 may be integrally coupled to a distal end of the upper panel assembly 102 and include a center section and opposing side sections. The center section, making up approximately ⅓ of the nose assembly 124, may have no taper while each of the opposing side sections may taper such that the thickness of each side section gradually tapers outwardly from the distal end of the upper panel assembly. In one embodiment, each side section may have a taper of 1/16 in. to 12 in. Tapering of the nose assembly 124 can allow the upper moveable belt 114 to remain centered on the upper panel 112. In one embodiment, the taper may be approximately 0.3 degrees.

A handle 123 may be secured to outer edges of the upper panel support members 117 via handle support members 125. The handle 123 may provide a means of moving the spineboard 100 into a position for loading and unloading a patient as well as moving the patient when he or she is disposed on the spineboard 100.

Figure 2A:
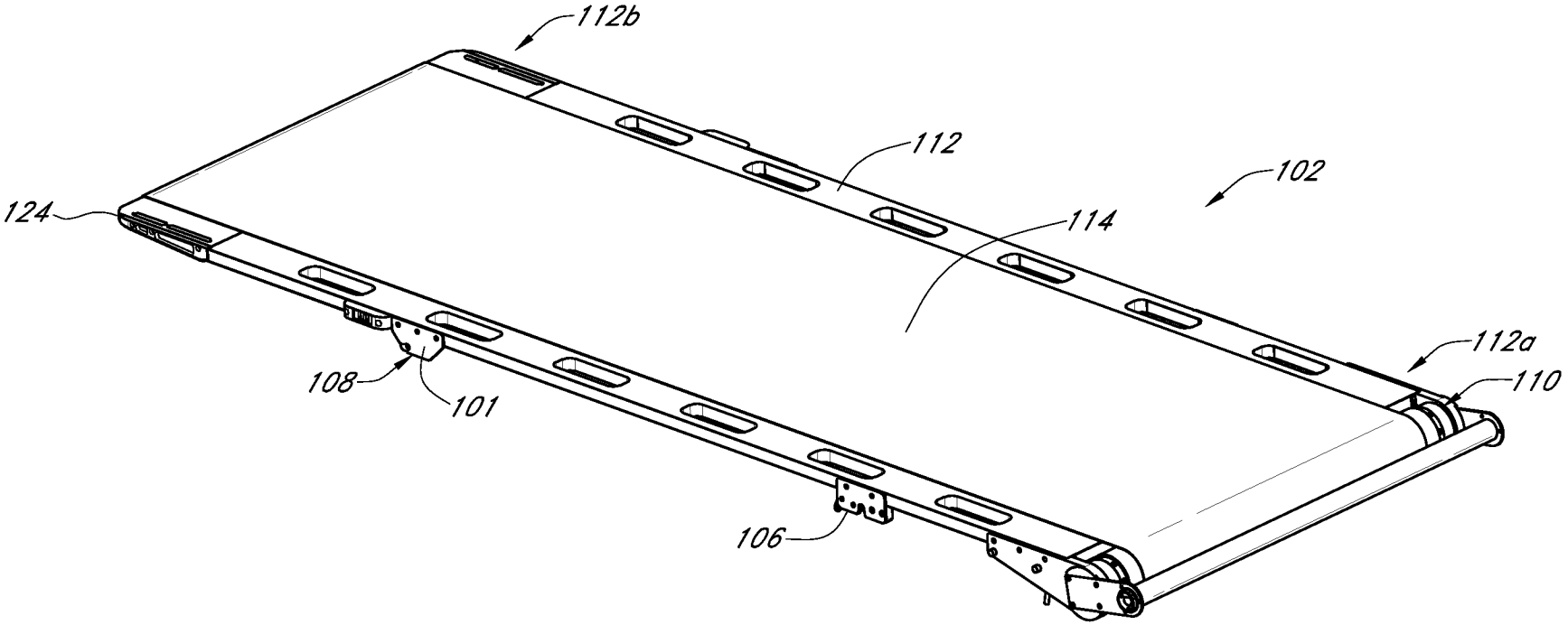
FIG. 2A illustrates a perspective view of an upper panel assembly of the spineboard of FIG. 1.

FIG. 2A illustrates a perspective view of the upper panel assembly 102 of the spineboard 100 of FIG. 1. In this view, the upper panel assembly 102 is shown with the upper drive assembly 110 secured to outer edges of the proximal end 112*a* of the upper panel 112. Upper moveable belt 114 is also shown wrapped about the upper panel 112 and the upper drive assembly 110. In some embodiments, upper moveable belt 114 is constructed of a flexible, polymeric material such as Nylon®, urethane or rubber. A component of one of the opposing latch assemblies 106 and one of the opposing hinge assemblies 108 are also shown. The nose assembly 124 is also shown integrally coupled to the upper panel 112 at the distal end 112*b* thereof. The nose assembly 124 may provide a narrowing cross section so that the spineboard can easily move underneath a person. Small rollers 127 (See FIG. 2B) may be located at the end of the spineboard nose assembly 124 allowing the upper moveable belt 114 to change directions with minimal friction. A switch 129, such as a rocker switch, may be located on the upper panel 112, for example near the hinge assembly 108, and may be used to control and change directions of the belts. As a result of the narrowing cross section, the nose portion also provides strength both laterally and longitudinally to the spineboard. Additionally, the narrowing cross section may keep the belt slightly elevated above the ground so that the upper moveable belt 114 does not scrub along the ground.

Figure 2B:
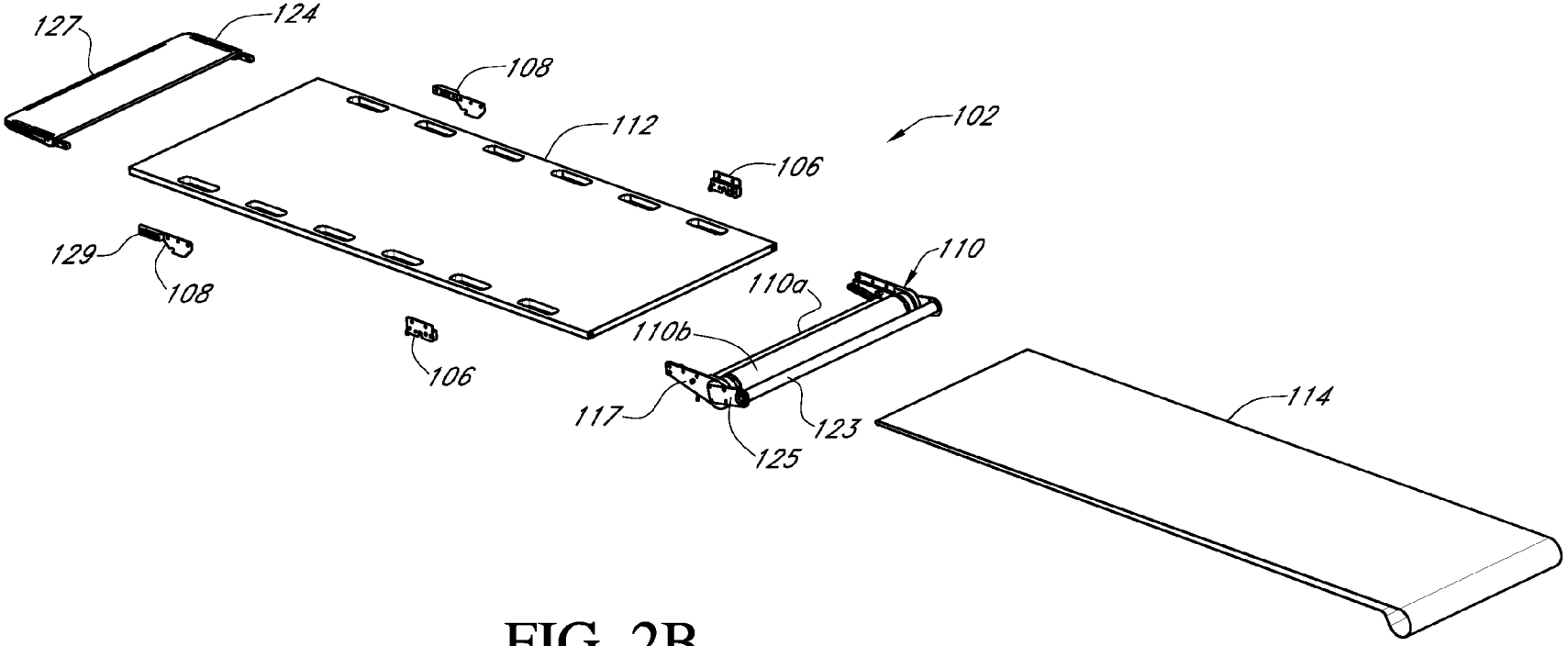
FIG. 2B illustrates an exploded view of the upper panel assembly of FIG. 2A.

FIG. 2B illustrates an exploded view of the upper panel assembly of FIG. 2A. In this view, one or more of the components comprising the upper panel assembly 102 are shown in relation to one another. More particularly, the orientations of the nose assembly 124, the upper drive assembly 110, the latch assemblies 106 and the hinge assemblies 108 relative to the upper panel 112 are more clearly illustrated. The upper moveable belt 114 is also shown in its entirety. In operation, the upper moveable belt 114 is wrapped about the upper panel 112 and the drive assembly 110 (see FIG. 2A).

Figure 3A:
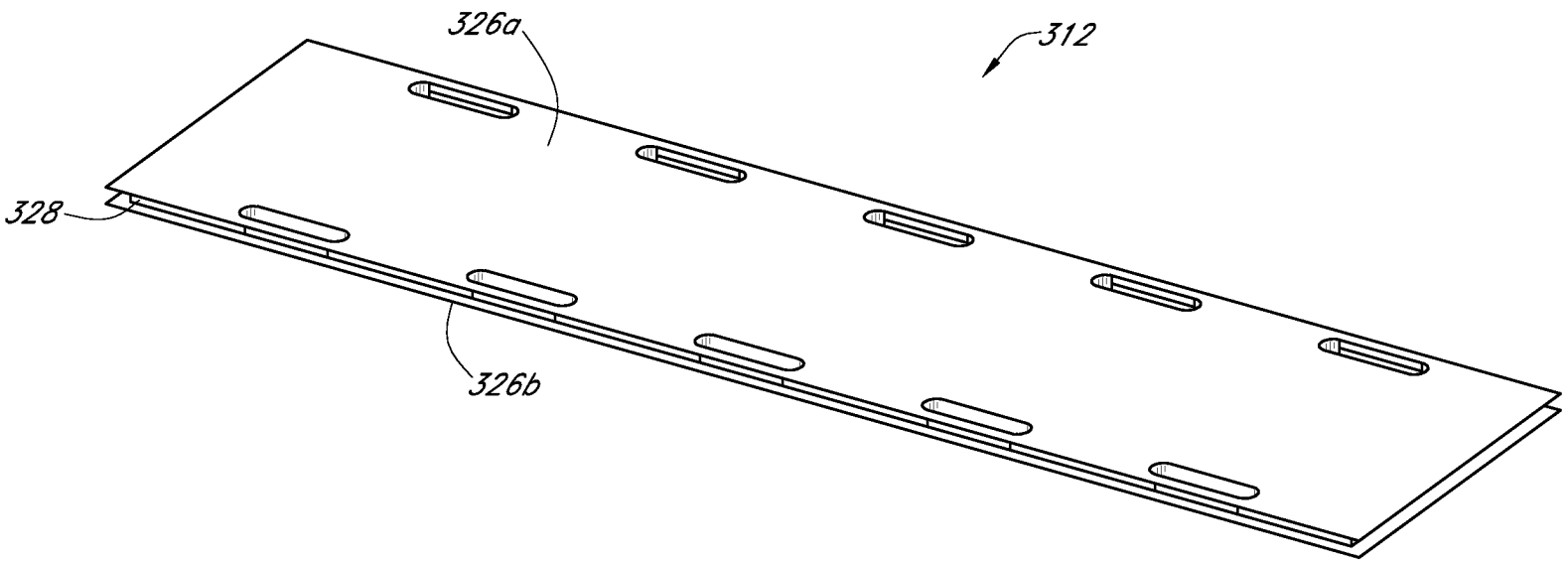
FIG. 3A illustrates a perspective view of an upper panel of a spineboard according to an embodiment of the invention.

FIG. 3A illustrates a perspective view of an upper panel of a spineboard according to an embodiment of the invention. In one embodiment, an upper panel 312 may be comprised of a core 328 sandwiched by at least two sheets 326 and supported by one or more supporting members (not shown, see FIG. 3B). In some embodiments, the sheets 326 are constructed of a lightweight material such as a metal, metal alloy or polymer-based material. Examples of particular materials which may comprise the sheets 326 include, but are not limited to, aluminum, stainless steel, Aramid™, graphite, fiberglass, polycarbonate and polypropylene. In a particular embodiment, an upper sheet 326*a* may be about 0.030 inches in thickness and a lower sheet 326*b* may be about 0.020 inches in thickness. Generally, the length and width of the upper panel 312 is sized to accommodate an average person. In a particular embodiment, the upper panel 312 may have a length between about 70 inches and about 78 inches and a width between about 18 inches and 30 inches. In some embodiments, the core 328 may be constructed of a lightweight honeycombed material which may include, but is not limited to, a metal, metal alloy or a polymer-based material. More particularly, materials which may comprise the core 328 include, but are not limited to, aluminum, stainless steel, Aramid™, polycarbonate, polyethylene and polypropylene. As known by those of ordinary skill in the art, honeycombed material has at least the following beneficial characteristics: light weight, high intensity, high stiffness, strong corrosion resistance, and stable performance.

Figure 3B:
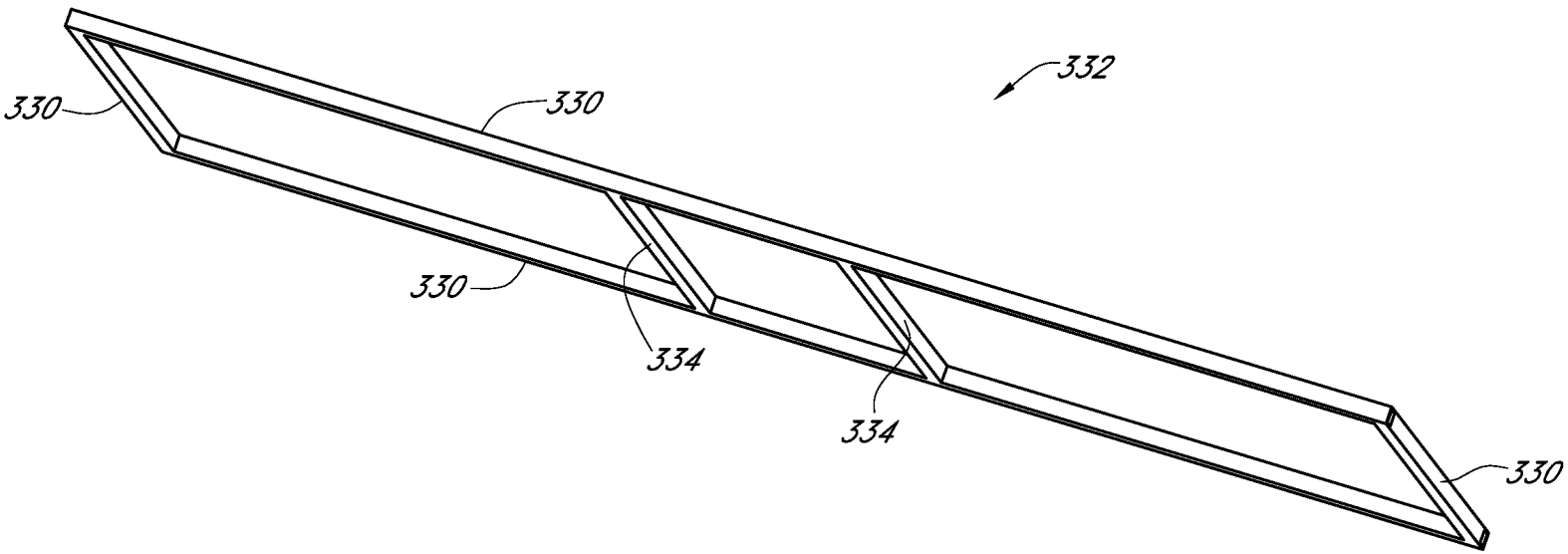
FIG. 3B illustrates a perspective view of a frame of an upper panel of a spineboard according to an embodiment of the invention.

FIG. 3B illustrates a perspective view of a frame of an upper panel of a spineboard according to an embodiment of the invention. In some embodiments, the length and the width of the sheets 326 (not shown, see FIG. 3A) may exceed the length and the width of the core 328 in order to accommodate peripheral supporting members 330. For example, in one embodiment, the length and the width of the sheets 326 (not shown, see FIG. 3A) may be between about 67.5 inches and about 30 inches while the length and the width of the core 328 (not shown, see FIG. 3A) may be between about 66 inches and about 28.5 inches thereby exceeding the core 328 by about 0.75 inch on all sides.

In some embodiments, the supporting members 330 are constructed of metal, metal alloy or polymer-based tubing. Examples of materials which may comprise the supporting members 330 include, but are not limited to, aluminum and stainless steel. In one embodiment, the supporting members 330 may comprise a peripheral frame 332 with one or more cross braces 334 passing through the core (not shown, see FIG. 3C). Advantageously, the cross braces 334 can provide additional strength and alignment to the assembled panel 312 (see FIG. 3B). In a particular embodiment, the supporting members 330 may be three-fourths (¾) inches aluminum tubing. In one embodiment, assembly of the panel 312 can be assembled by constructing the peripheral frame 332, sizing one or more pieces of the core 318 to fit within supporting members 330 and the one or more cross braces 334.

Figure 3C:
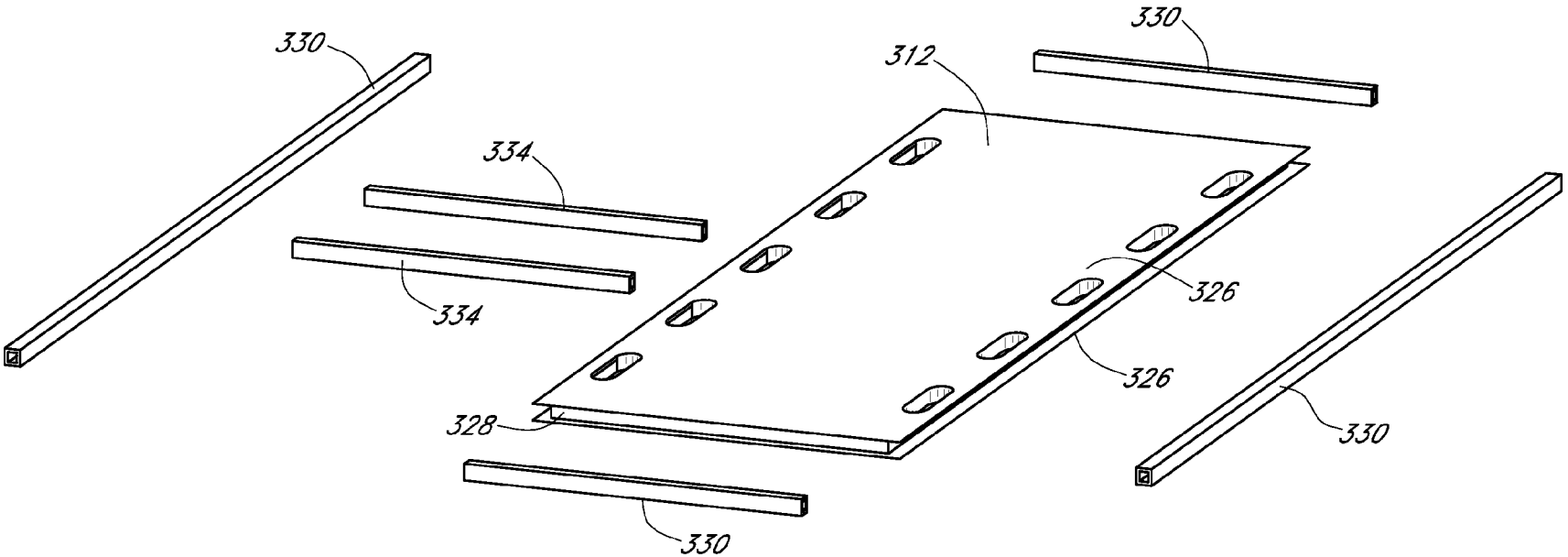
FIG. 3C illustrates an exploded view of supporting members and an upper panel of a spineboard according to an embodiment of the invention.

FIG. 3C illustrates an exploded view of supporting members 330 and an upper panel of a spineboard according to an embodiment of the invention. In one method of assembly, the components comprising the upper panel 312 may be assembled as follows. Supporting members 330 assembled as a peripheral frame may be welded together. One or more cross braces 334 may be positioned transversely within an interior of the peripheral frame 332 and then components comprising the core 328 may be put into position within the open spaces within supporting members 330 and the one or more cross braces 334. Finally, the sheets 326 may be positioned to sandwich the peripheral frame 338, having the core 328, and the assembly is placed into a heated press which applies pressure over the entire assembly to affix the components together.

Figure 4:
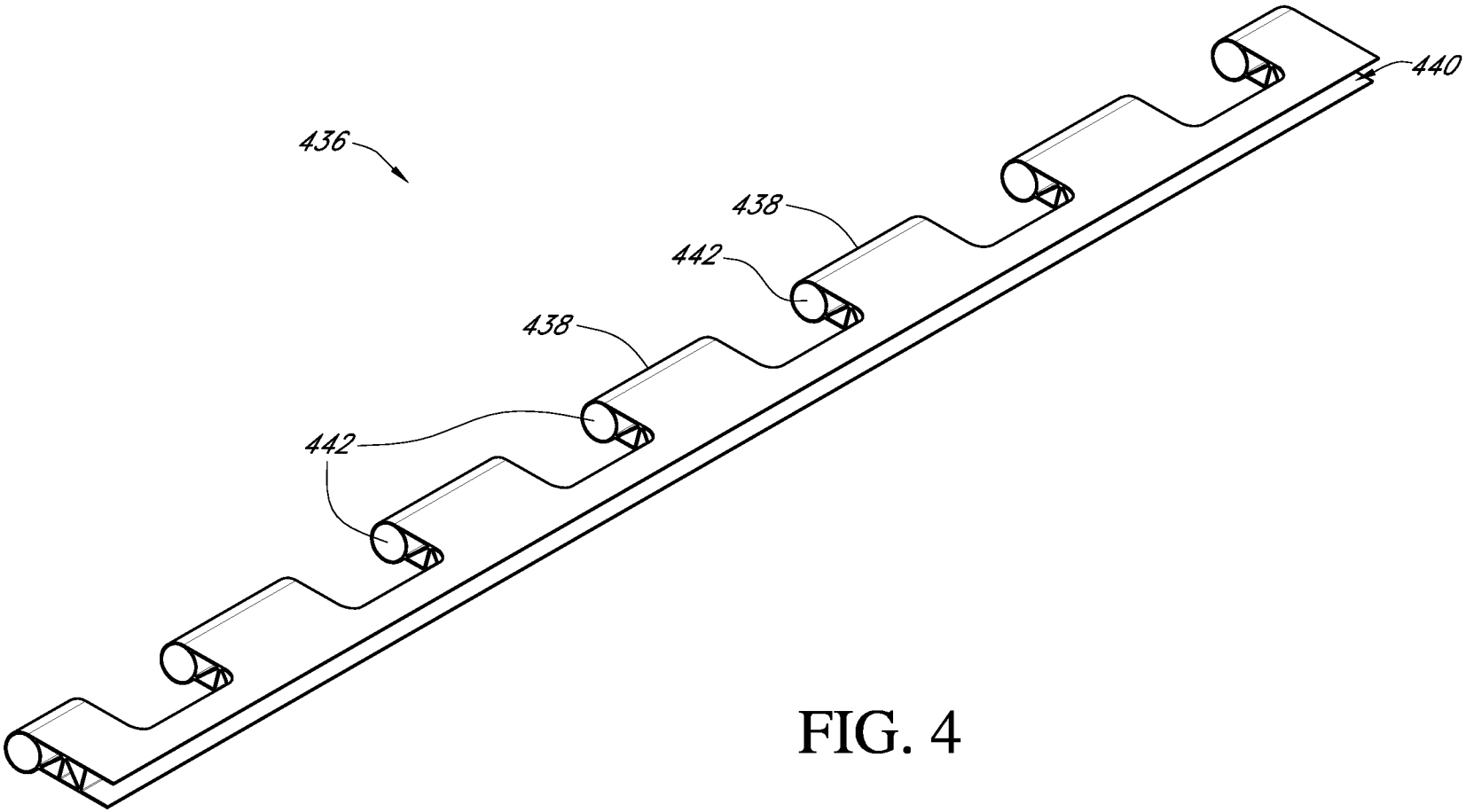
FIG. 4 illustrates a perspective view of a peripheral handhold to couple to an upper panel of a spineboard according to an embodiment of the invention.
Figure 5C:
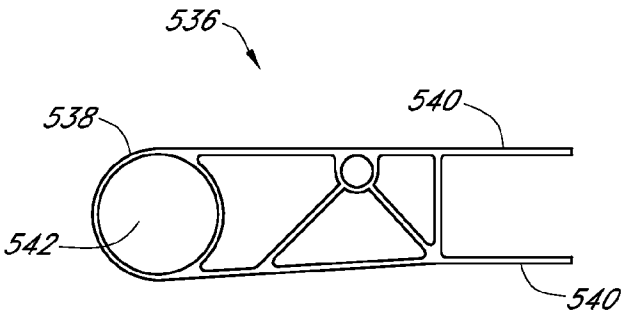
FIGS. 5A-5D illustrate cross-sectional views of peripheral handholds to couple to an upper panel of a spineboard according to an embodiment of the invention.
Figure 5A:
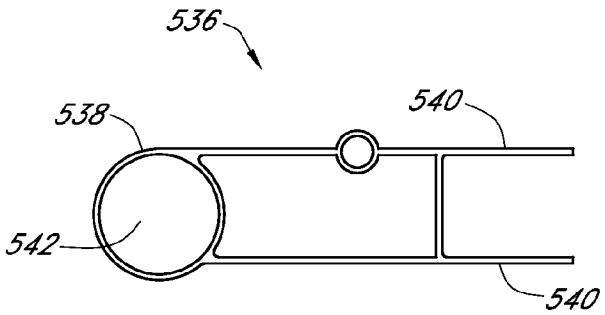
Figure 5D:
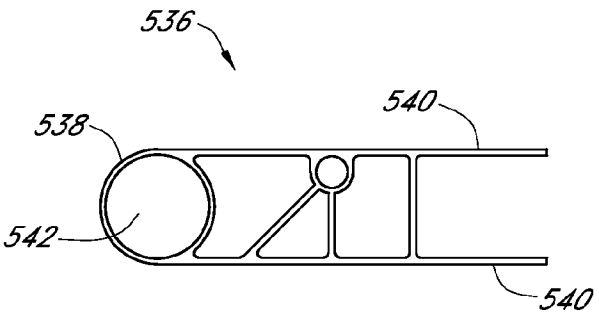
Figure 5B:
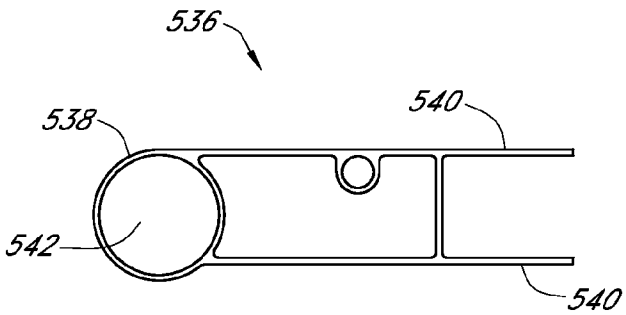

FIG. 4 illustrates a perspective view of a peripheral handhold to couple to an upper panel of a spineboard according to an embodiment of the invention. In some embodiments, peripheral handholds 436 may be secured to an upper panel. A peripheral handhold 436 is an elongated member having a plurality of handholds 438 along one edge and flanged 440 on the opposing edge and adapted to couple to an upper panel (not shown, see FIG. 6). In some embodiments, the handholds 438 are evenly spaced along the length of the peripheral handhold 436. The handholds 438 may each define an opening 442 with which to receive a tubular reinforcement member (see FIG. 6) to provide extra stability and support to the device when a patient is loaded thereon. Examples of materials which may comprise the peripheral handhold 436 are constructed of metal, metal alloy or polymer-based material.

FIGS. 5A-5D illustrate cross-sectional views of peripheral handholds to couple to an upper panel of a spineboard according to embodiments of the invention. In each embodiment, the peripheral handhold 536 includes a handhold portion 538 defining an opening 542 and a flange 540 suitable for coupling to an upper panel (not shown, see FIG. 6). Each embodiment of the peripheral handhold 536 may vary in configuration in the portion between the handhold portion 538 and the flange 540 as shown.

Figure 6:
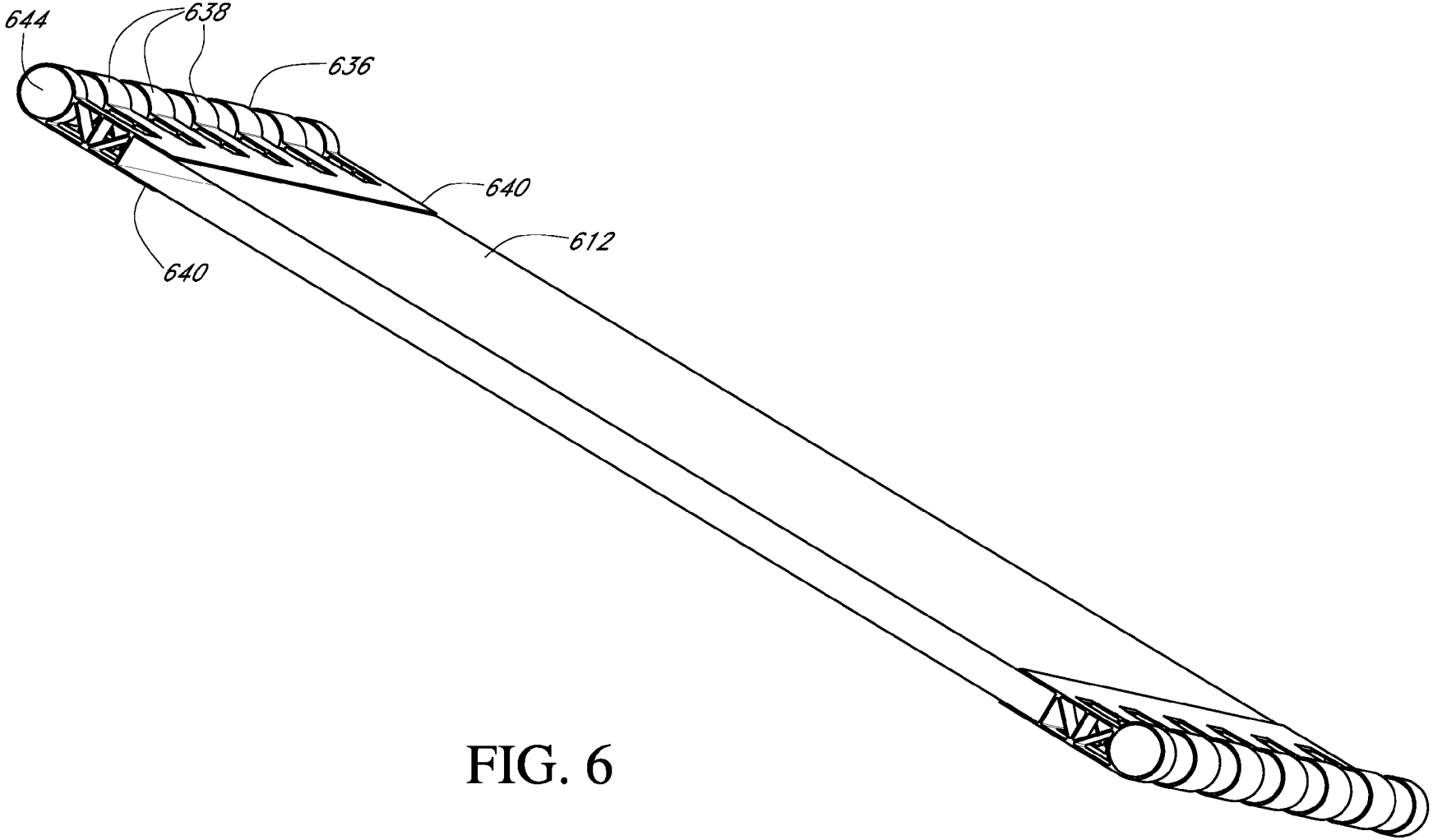
FIG. 6 illustrates a perspective view of an upper panel coupled to a peripheral handhold according to an embodiment of the invention.

FIG. 6 illustrates a perspective view of an upper panel coupled to a peripheral handhold according to an embodiment of the invention. In this view, the coupling of the peripheral handhold 636 via flange 640 to an upper panel 612 is illustrated. Also shown is a tubular reinforcement member 644 which may be inserted throughout the length of the peripheral handhold 636 via openings defined by handholds 638.

Figure 7A:
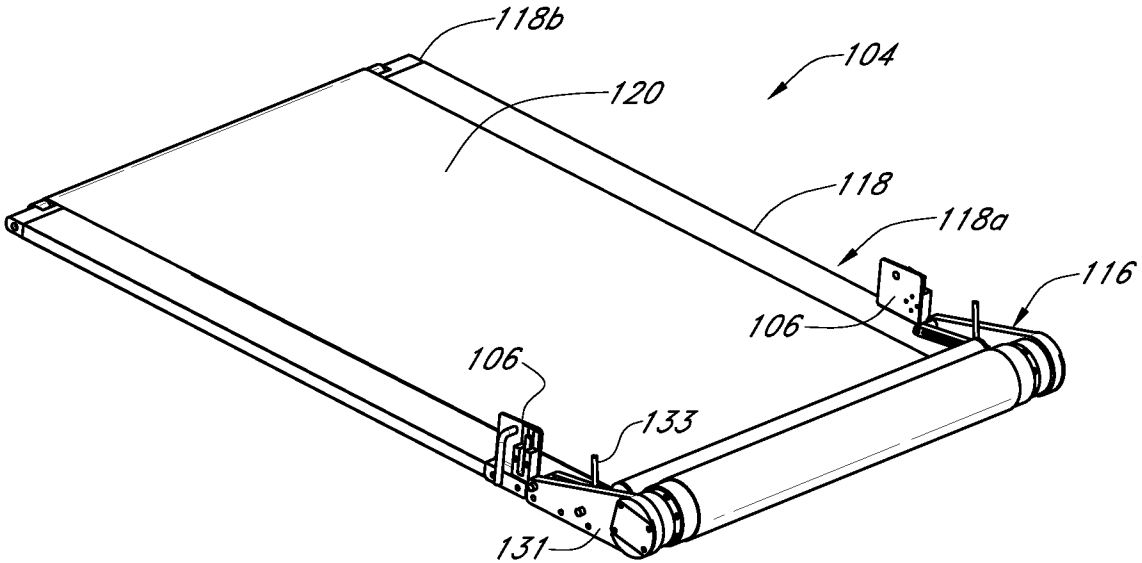
FIG. 7A illustrates a perspective view of a lower panel assembly of the spineboard of FIG. 1.

FIG. 7A illustrates a perspective view of the lower panel assembly of the spineboard of FIG. 1. In this view, the lower panel assembly 104 is shown with the lower drive assembly 116 secured to outer edges of the proximal end 118*a* of the lower panel 118 (as opposed to distal end 118*b*). Lower moveable belt 120 is also shown wrapped about the lower panel 118 and the lower drive assembly 116. In some embodiments, lower moveable belt 120 is constructed of a flexible, polymeric material such as Nylon® or rubber. The opposing proximally located latch assemblies 106 are also shown.

Figure 7B:
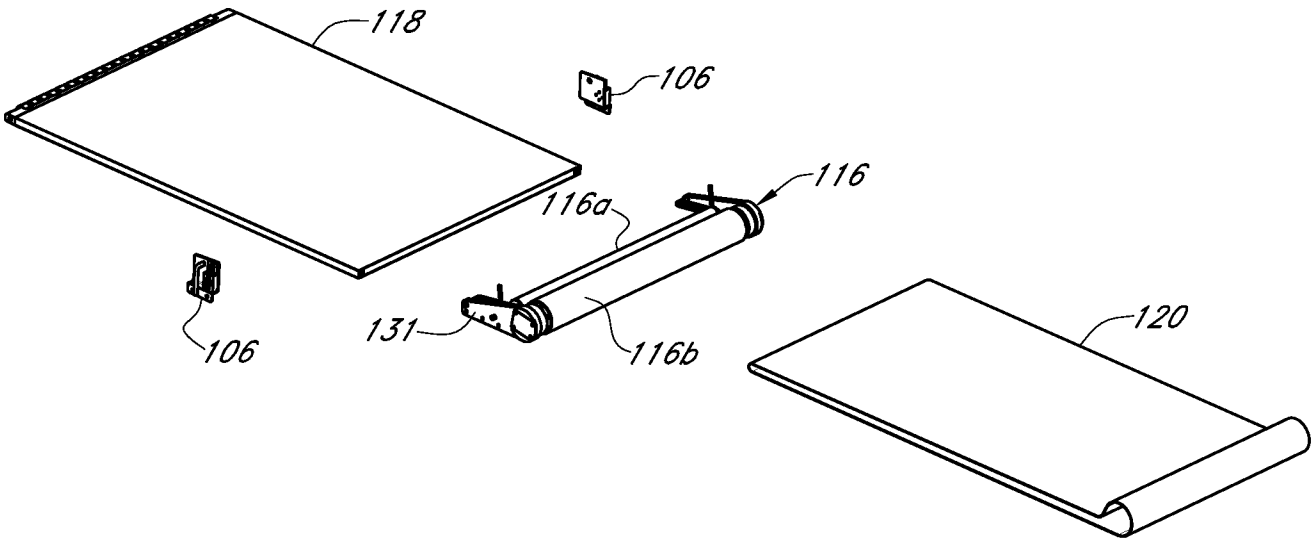
FIG. 7B illustrates an exploded view of the lower panel assembly of FIG. 7A.

FIG. 7B illustrates an exploded view of the lower panel assembly of FIG. 7A. In this view, one or more of the components comprising the lower panel assembly 104 are shown. More particularly, the orientations of the lower drive assembly 116, the latch assembly 106 relative to the lower panel 118 as well as relative to one another are more clearly illustrated. The lower moveable belt 120 is also shown in its entirety. In operation, the lower moveable belt 120 is wrapped about the lower panel 118 and the lower drive assembly 116 (see FIG. 7A).

The spineboard, according to embodiments of the invention, may be used in the field by emergency personnel to load and transport a patient in a supine position. For patients suffering suspected spinal or limb injuries of undetermined severity, it is very important to keep the patient supine and stabilized while loading, transporting and unloading the patient from the injury site to a medical facility.

In operation, the spineboard, according to embodiments of the invention, may be used as follows. The distal end of the upper panel assembly of the spineboard may be positioned at the feet of the patient. When the motorized drive rollers are actuated, the upper and lower belts counter rotate relative to one another. More particularly, the lower belt moves toward the patient as it gains traction from the ground or surface where the patient lies, while the upper belt moves away from the patient to load the patient thereon (i.e., by conveyance). In some embodiments, the speed of the belts is between about 0.10 feet per second and about 0.12 feet per second. Once the patient is loaded onto the upper panel assembly, the lower panel assembly can be detached from the upper panel assembly. As a result, the patient may be gently loaded and unloaded without lifting or manipulating the patient.

In this manner, at least the following benefits may be provided to the spineboard according to embodiments of the invention: (1) reducing movement of the patient when moving onto the spineboard as compared to conventional spineboards; (2) after loading a patient, the lower panel can be easily unlatched from the upper panel so as not to soil the bottom surface of the upper panel when unloading the patient; and (3) maintenance, such as changing of the belts, is easier.

While certain exemplary embodiments have been described and shown in the accompanying drawings, it is to be understood that such embodiments are merely illustrative of and not restrictive on the broad application, and that this application is not limited to the specific constructions and arrangements shown and described, since various other modifications may occur to those ordinarily skilled in the art.

What is claimed is:

1. A transport device, comprising:

an upper panel assembly having an upper panel proximal end and an upper panel distal end;

a lower panel assembly, having a lower panel proximal end and a lower panel distal end, detachably joined to the upper panel assembly by one or more latch assemblies and one or more hinge assemblies, the lower panel assembly having a length less than a length of the upper panel assembly, so that the lower panel assembly is latched in a closed position by the latch assembly when the latch assembly is latched, and is free to pivot about the hinge assembly to an open position when the latch is released;

an upper moveable belt wrapped about the upper panel assembly, the upper moveable belt driven by an upper drive assembly secured to the upper panel proximal end; and a lower moveable belt wrapped about the lower panel assembly, the lower moveable belt driven by a lower drive assembly secured to the lower panel proximal end, the upper moveable belt and the lower moveable belt counter-rotate relative to one another.

2. The transport device of claim 1, wherein the upper panel assembly further comprises an upper panel having an upper sheet and a lower sheet with a core sandwiched therebetween.

3. The transport device of claim 2, wherein the upper panel defines a rectangular configuration, a length and a width of the upper and lower sheets exceed a length and a width of the core.

4. The transport device of claim 2, further comprising two peripheral handholds coupled to the upper panel along each length thereof.

5. The transport device of claim 4, wherein each peripheral handhold comprises a plurality of evenly spaced handholds, each handhold defining an opening wherein each opening is configured to receive a tubular reinforcement member.

6. The transport device of claim 1, wherein the upper drive assembly comprises:

a first motorized drive roller; and an upper idler roller oriented parallel with and spaced apart from the first motorized drive roller.

7. The transport device of claim 1, wherein the lower panel assembly further comprises a lower panel, the lower panel comprising an upper sheet and a lower sheet with a core sandwiched therebetween.

8. The transport device of claim 1, wherein the lower drive assembly comprises:

a second motorized driver roller; and a lower idler roller oriented parallel with and spaced apart from the second motorized drive roller.

9. The transport device of claim 1, wherein the upper panel assembly further comprises a nose assembly coupled to a distal end thereto, the nose assembly comprising a center section integrally connected to opposing side sections, wherein the thickness of each of the opposing side sections gradually tapers outwardly from the distal end of the upper panel assembly.

10. The transport device of claim 1, wherein the one or more latch assemblies each comprise latch bars secured to the lower panel assembly and two-stage rotary type latches secured to the upper panel assembly for releasable engagement with the latch bars.

11. The transport device of claim 1, wherein the one or more hinge assemblies each comprise an upper hinge support member secured to the upper panel assembly and a pin secured to the lower panel assembly.

12. A transport device comprising:

an upper panel assembly comprising:

an upper panel; and an upper drive assembly secured to a proximal end of the upper panel;

a lower panel assembly detachably joined to the upper panel assembly by one or more latch assemblies and one or more hinge assemblies, the lower panel assembly comprising:

a lower panel having a length less than a length of the upper panel assembly; and a lower drive assembly secured to a proximal end of the lower panel;

an upper moveable belt wrapped about the upper panel assembly, the upper moveable belt driven by the upper drive assembly; and a lower moveable belt wrapped about the lower panel assembly, the lower moveable belt driven by the lower drive assembly, the upper moveable belt and the lower moveable belt counter-rotate relative to one another.

13. The transport device of claim 12, wherein the upper panel comprises an upper core sandwiched between an upper sheet and a lower sheet and wherein the upper panel defines a rectangular configuration, a length and a width of the upper and lower sheets exceed a length and a width of the upper core.

14. The medical transport device of claim 12, wherein the lower panel comprises a lower core sandwiched between an upper sheet and a lower sheet and wherein the lower panel defines a rectangular configuration, a length and a width of the upper and lower sheets exceed a length and a width of the lower core.

15. The transport device of claim 12, wherein the upper drive assembly comprises:

a first motorized drive roller; and an upper idler roller oriented parallel with and spaced apart from the first motorized drive roller.

16. The transport device of claim 12, wherein the lower drive assembly comprises:

a second motorized driver roller; and a lower idler roller oriented parallel with and spaced apart from the second motorized drive roller.

17. The transport device of claim 12, further comprising two peripheral handholds coupled to the upper panel of the upper panel assembly along each length thereof, each peripheral handhold comprising a plurality of evenly spaced handholds, each handhold defining an opening wherein each opening is configured to receive a tubular reinforcement member.

18. The transport device of claim 12, wherein the upper panel assembly further comprises a nose assembly coupled to a distal end thereto, the nose assembly having a center section integrally connected to opposing side sections, wherein the thickness of each of the opposing side sections gradually tapers outwardly from the distal end of the upper panel assembly.

19. The transport device of claim 12, wherein the one or more latch assemblies each comprise latch bars secured to the lower panel assembly and two-stage rotary type latches secured to the upper panel assembly for releasable engagement with the latch bars.

20. The transport device of claim 12, wherein the one or more hinge assemblies each comprise an upper hinge support member secured to the upper panel assembly and a pin secured to the lower panel assembly.

* * * * *